US009216453B2

(12) United States Patent
Hann et al.

(10) Patent No.: US 9,216,453 B2
(45) Date of Patent: Dec. 22, 2015

(54) METHODS OF FORMING DUAL MICROSTRUCTURE COMPONENTS

(75) Inventors: Brian Hann, Avondale, AZ (US); Derek Anthony Rice, Phoenix, AZ (US); Daniel Greving, Scottsdale, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 589 days.

(21) Appl. No.: 12/622,694

(22) Filed: Nov. 20, 2009

(65) Prior Publication Data

US 2011/0123385 A1 May 26, 2011

(51) Int. Cl.

| | |
|---|---|
| ***B22F 3/15*** | (2006.01) |
| ***B22F 3/24*** | (2006.01) |
| ***C22C 19/05*** | (2006.01) |
| *B22F 5/00* | (2006.01) |

(52) U.S. Cl.

CPC ..... *B22F 3/24* (2013.01); *C22C 19/056* (2013.01); *B22F 5/003* (2013.01); *B22F 2998/10* (2013.01); *F05D 2220/31* (2013.01)

(58) Field of Classification Search

CPC ..... B22F 3/24
USPC ..... 419/28
See application file for complete search history.

(56) References Cited

U.S. PATENT DOCUMENTS

| | | | | |
|---|---|---|---|---|
| 4,820,356 | A | 4/1989 | Blackburn et al. | |
| 4,957,567 | A | 9/1990 | Krueger et al. | |
| 5,080,734 | A | 1/1992 | Krueger et al. | |
| 5,269,857 | A | 12/1993 | Ganesh et al. | |
| 5,312,497 | A * | 5/1994 | Mathey | 148/675 |
| 5,413,752 | A | 5/1995 | Kissinger et al. | |
| 5,527,402 | A | 6/1996 | Ganesh et al. | |
| 5,529,643 | A | 6/1996 | Yoon et al. | |
| 5,649,280 | A | 7/1997 | Blankenship et al. | |
| 5,693,159 | A | 12/1997 | Athey et al. | |

(Continued)

FOREIGN PATENT DOCUMENTS

EP 1195446 A1 4/2002

OTHER PUBLICATIONS

D.A. DeAntonio, D. Duhl, T. Howson, and M.F. Rothman, Heat Treating of Superalloys, Heat Treating, vol. 4, ASM Handbook, ASM International, 1991, p. 793-814 (as excerpted from ASM Handbooks Online).*

(Continued)

*Primary Examiner* — Jessee Roe
*Assistant Examiner* — Christopher Kessler
(74) *Attorney, Agent, or Firm* — Ingrassia Fisher & Lorenz, P.C.

(57) ABSTRACT

Methods of forming dual microstructure components include consolidating a powder material comprising an alloy to form a billet, the billet having a first grain structure, inductively heating the billet at an inductive heat treat temperature above a gamma prime solvus temperature of the alloy and subjecting the billet to a subsolvus heat treat temperature that is below the gamma prime solvus temperature of the alloy, waiting a period of time for the first grain structure in an outer portion of the billet to transform into a second grain structure that is coarser than the first grain structure, after the steps of inductively heating and subjecting the billet to the subsolvus heat treat temperature. The methods also include dividing the billet into at least two sections, and machining a final shape into one or more of the at least two sections to form the dual microstructure component.

16 Claims, 3 Drawing Sheets

(56) References Cited

U.S. PATENT DOCUMENTS

| | | | | |
|---|---|---|---|---|
| 5,759,305 | A | 6/1998 | Benz et al. | |
| 6,478,896 | B1 | 11/2002 | Ganesh et al. | |
| 6,551,372 | B1 * | 4/2003 | Ewing et al. | 75/246 |
| 6,565,683 | B1 | 5/2003 | Utyashev et al. | |
| 6,660,110 | B1 | 12/2003 | Gayda et al. | |
| 6,866,727 | B1 | 3/2005 | Hieber et al. | |
| 6,969,431 | B2 | 11/2005 | Hieber et al. | |
| 6,974,508 | B1 * | 12/2005 | Gabb et al. | 148/428 |
| 7,537,725 | B2 | 5/2009 | Groh et al. | |
| 2005/0081968 | A1 | 4/2005 | Groh et al. | |
| 2009/0071580 | A1 | 3/2009 | Mitchell et al. | |

OTHER PUBLICATIONS

EP Examination Report for Application No. 10186768.7 dated Sep. 3, 2014.

EP Search Report for Application No. 10186768.7 dated Aug. 18, 2014.

EP Examination Report for Application No. 10186768.7 dated Mar. 13, 2015.

* cited by examiner

METHODS OF FORMING DUAL MICROSTRUCTURE COMPONENTS

TECHNICAL FIELD

The inventive subject matter generally relates to dual microstructure components, and more particularly relates to methods of forming dual microstructure components.

BACKGROUND

During operation of a gas turbine engine, a turbine wheel typically rotates at high speeds in a high temperature environment. The turbine wheel includes a disk that supports a plurality of turbine blades. In many cases, a hub portion of the disk is exposed to temperatures of about 535° C., while a rim portion of the disk is exposed to higher temperatures, such as about 815° C. or higher. Because of these differences in operating conditions, hubs have been configured to have the qualities of high tensile strength and high resistance to low cycle fatigue, while rims have been configured to have the qualities of high stress rupture and creep resistance. Such hubs fall into the category of dual microstructure components.

Several techniques currently exist for constructing turbine wheel hubs having such dual properties. One technique includes forming a disk preform having a hub and a rim formed of alloys having different properties. For example, the hub may comprise a first alloy capable of exhibiting a first set of properties, while the rim may comprise a second alloy capable of exhibiting a second set of properties. In this case, the two alloys may be joined by a diffusion heat treatment, extrusion or another manner. In another example, the disk preform may initially have a first grain structure, and specialized equipment may heat an outer periphery of the disk preform to obtain a second grain microstructure. Although the aforementioned processing techniques yield high quality disks, only one disk may be produced at a time from each preform. Additionally, the techniques may not be suitable for forming parts meeting a particular quality standard or for producing relatively smaller-diameter components, such as disks for auxiliary power units.

Accordingly, it is desirable to have an improved method for forming a dual microstructure component. In addition, it is desirable for the improved method to be relatively inexpensive and simple to perform. Moreover, it is desirable for the improved method to be capable of producing dual microstructure components that may be used in relatively smaller-diameter components, such as auxiliary power units. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Methods of forming dual microstructure components are provided.

In an embodiment, by way of example only, a method includes consolidating a powder material comprising an alloy to form a billet, the billet having a first grain structure, inductively heating the billet at an inductive heat treat temperature above a gamma prime solvus temperature of the alloy and subjecting the billet to a subsolvus heat treat temperature that is below the gamma prime solvus temperature of the alloy, waiting a period of time for the first grain structure in an outer portion of the billet to transform into a second grain structure that is coarser than the first grain structure, after the steps of inductively heating and subjecting the billet to the subsolvus heat treat temperature, dividing the billet into at least two sections, and machining a final shape into one or more of the at least two sections to form the dual microstructure component.

In another embodiment, by way of example only, a method includes consolidating a powder material comprising an alloy to form a billet, the billet having a first grain structure, inductively heating the billet at an inductive heat treat temperature above a gamma prime solvus temperature of the alloy, waiting a period of time for the first grain structure in an outer portion of the billet to transform into a second grain structure that is coarser than the first grain structure, dividing the billet into at least two sections, subjecting one or more of the at least two sections to a subsolvus heat treat temperature that is below the gamma prime solvus temperature of the alloy, and machining a final shape into the one or more of the at least two sections for form the dual microstructure component.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the inventive subject matter or the application and uses of the inventive subject matter. Furthermore, there is no intention to be bound by any theory presented in the preceding background or the following detailed description.

Generally, the inventive subject matter relates to a method of forming a dual microstructure component by forming a billet comprising an alloy and having a first grain structure. The billet then may be inductively heated at an inductive heat treat temperature above a gamma prime solvus temperature of the alloy. The billet also may be subjected to a subsolvus heat treat temperature that is below the gamma prime solvus temperature of the alloy. After the inductive heat treatment, the method including waiting a period of time for the first grain structure in an outer diameter portion of the billet to transform into a second grain structure that is coarser than the first grain structure. The billet may be divided into at least two sections, and a final shape is machined into one or more of the at least two sections to form the dual microstructure component.

Figure 1:
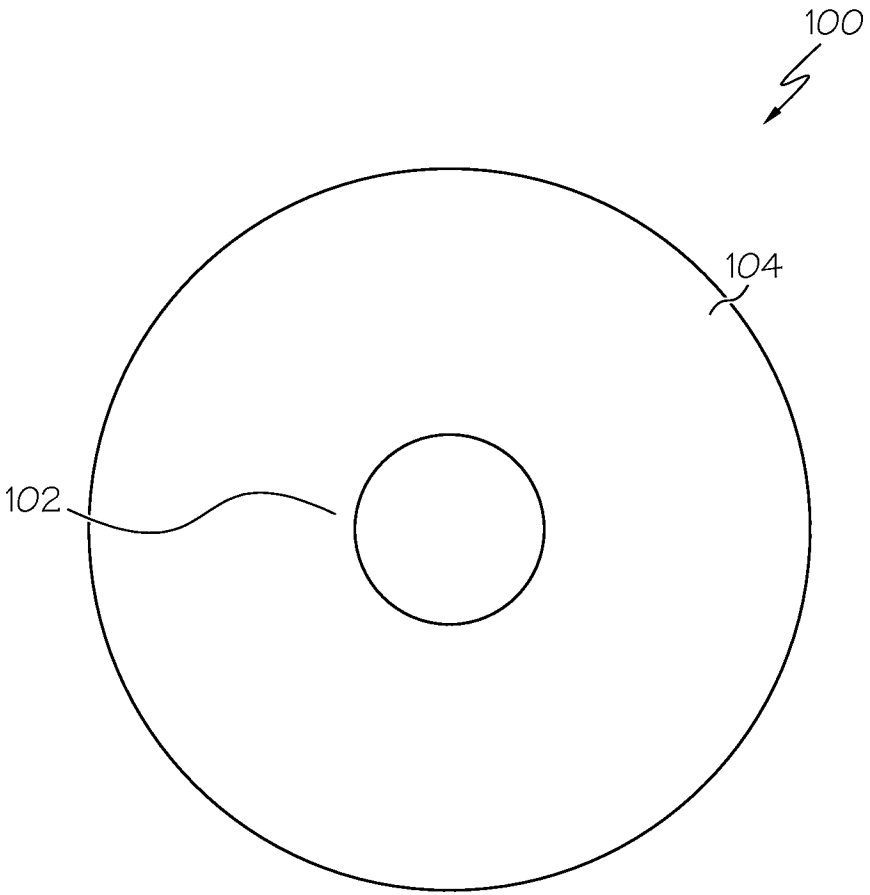
FIG. 1 is a simplified schematic of a turbine disk, according to an embodiment.

The method may be employed to form a variety of components in which dual microstructures may be desired. One example of a component in which a dual microstructure may be desired is a turbine disk. FIG. 1 is a simplified schematic of a turbine disk 100, according to an embodiment. The turbine disk 100 includes a hub 102 and a rim 104, each having different material properties. In this regard, the hub 102 and the rim 104 may have different microstructures. In an embodiment, the hub 102 may have a first grain structure, and the rim 104 may have a second grain structure that is different from the first grain structure. For example, the hub 102 may be configured to have the properties of high tensile strength and high resistance to low cycle fatigue. According to an embodiment, the first microstructure may be a fine-grained microstructure. The fine-grained microstructure may comprise grains with an average size between about 5 microns and about 10 microns in size. According to an embodiment, the rim 104 may be configured to have the properties of high stress rupture and creep resistance. In an embodiment, the second microstructure may comprise a coarse-grained microstructure. The coarse-grained microstructure has grains that are larger than those of the fine-grained microstructure. For example, the coarse-grained microstructure may have grains with an average size between about 15 microns and about 30 microns in size. In other embodiments, the grain sizes of the fine-grained microstructure and/or the coarse-grained microstructure may be larger or smaller than the aforementioned ranges.

Figure 2:
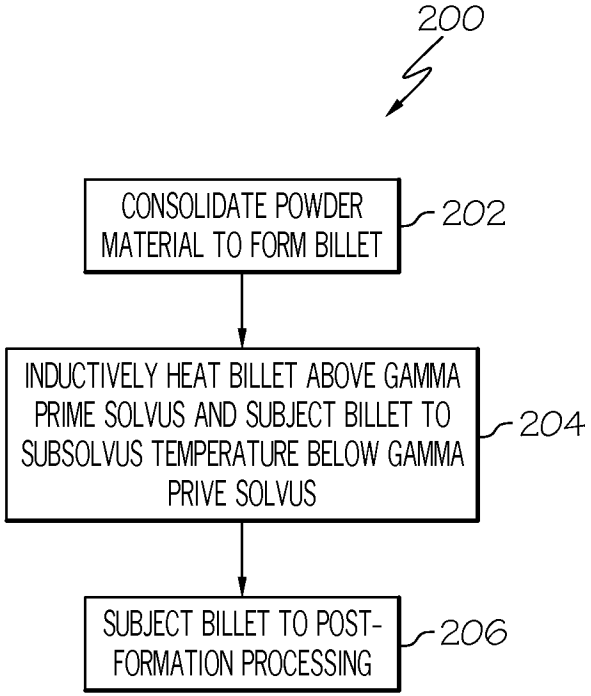
FIG. 2 is a flow diagram of a method of forming a dual microstructure component, according to an embodiment.

FIG. 2 is a flow diagram of a method of forming a dual microstructure component, such as the turbine disk 100, auxiliary power units or other components, according to an embodiment. In an embodiment, powder material comprising an alloy is consolidated to form a billet, step 202. According to an embodiment, the powder material may comprise a nickel base superalloy. Suitable examples include, but are not limited to Alloy 10, Astroloy, and Alloy 720. To prepare the powder material, a selected alloy may be atomized into spherical particles by inert gas atomization, in an embodiment. For example, a high pressure, high velocity stream of inert gas may be directed at a molten form of the selected alloy. Examples of inert gases that are typically employed include, but are not limited to, argon, helium, and nitrogen. According to another embodiment, other inert gases may be employed. As the molten alloy cools, particles are formed to yield the powder material. The powder material may have average particle diameters in a range of about 5 microns to about 53 microns, in an embodiment. In other embodiments, the particle diameters may be larger or smaller than the aforementioned range. In still other embodiments, the powder material may be formed by employing other particle formation processes.

After the powder material is formed, it may be subjected to additional processes for removal of unwanted elements. For example, the powder material may be sealed within a container, a reactant gas may be introduced into the container, and the container may be outgassed to thereby remove at least a portion of the unwanted elements. The powder material may also be screened (i.e., passed through a screen) to remove particles having diameters that are larger than desired.

Next, the powder material may be consolidated to form a billet having a first grain structure. According to an embodiment, a particular process for consolidating the powder material may be selected based on a desired grain size for the first grain structure. For example, the powder material may be consolidated by a hot isostatic pressing (HIP) process. In such case, the billet may be formed to include grains having an average size in a range of about 9 to about 13 (as determined in accordance with ASTM E112), in an embodiment. In other embodiments, the grain sizes may be about ASTM 10.0 in size. In accordance with an embodiment, to perform a HIP process for consolidating the powder material, a desired quantity of the powder material may be placed into a hermetically sealed HIP container. The HIP container may comprise a mild steel or stainless steel or another type of container capable of serving as a high pressure containment vessel. In any case, the HIP container may be configured to have an inner surface that corresponds to a desired outer surface shape of the billet. For example, the inner surface may define a cylindrical volume to thereby form a cylindrical solid after the HIP process. In other embodiments, the inner surface may define a cubical, spherical, solid rectangular or a different shaped solid. In any case, the dimensions defined by the inner surface of HIP container are larger than the dimensions of a desired outer surface of the dual microstructure component. In an embodiment, the inner dimensions of the HIP container may be in a range of about 5 cm to about 50 cm. In other embodiments, the inner dimensions may be larger or smaller.

The powder material may be exposed to an elevated temperature and pressure, while an inert gas, such as argon, helium or nitrogen, is introduced into the HIP vessel. In an embodiment, the elevated temperature may be in a range of about 1090° C. and about 1150° C., and the elevated pressure may be in a range of about 14000 psi and about 15000 psi. In other embodiments, the temperature and pressure used in the HIP process may be less than or greater than the aforementioned ranges, as long the operating parameters are sufficient for reducing the density of the powder material to form a solid billet.

In some cases, the HIP process may be sufficient to produce a solid billet having grains of a desired size. In other embodiments, finer grains may be preferred. For example, grains having an average size in a range of about 13 to about 15 (as determined in accordance with ASTM E112), or having a size of about ASTM 14.0 may be preferred. In such cases, the HIP process may form a densified substrate, which may be subjected to an additional process to further reduce the sizes of the grains in the densified substrate and form the billet having a desired first grain structure. In an embodiment, the densified substrate may be extruded. For example, in accordance with an embodiment, the densified substrate may be forced through a suitably-dimensioned opening of an extrusion die. The opening may be configured to define a shape that corresponds to a desired cross sectional shape of the billet. For example, the surface shape of the opening may define a circle to thereby form a solid cylindrical billet after extrusion. In other embodiments, the surface shape of the opening may define a square, rectangle or another shape. According to an embodiment, the densified substrate may be hot extruded and, hence, may be heated prior to being forced through the extrusion die. Hot extrusion may be desired when subsequent forging processes are employed or a more pronounced difference in microstructure is desired.

In another embodiment, the powder material may be not be subjected to the HIP process, and alternatively may be consolidated only by extrusion to form the billet. Such an embodiment may be employed when subsequent forging processes are employed or a more pronounced difference in microstructure is desired.

According to an embodiment, the billet may be inductively heated at an inductive heat treat temperature above a gamma prime solvus temperature of the alloy and subjected to a subsolvus heat treat temperature that is below the gamma prime solvus temperature of the alloy, step 204. For example, the billet may be placed in an induction heating apparatus, which may include a coil coupled to a power supply. The induction coil may have an inner diameter that is greater than outer dimensions of the billet. When alternating current is supplied to the induction coil, a magnetic field is produced. As the billet passes through the induction coil, the magnetic field induces eddy currents in the billet.

As noted briefly above, the inductive heat treatment is performed above the gamma prime solvus temperature of the alloy. The inductive heat treatment may be performed to transform an outer portion of the billet from the first grain structure to a second grain structure, where an "outer portion" means a portion that is relatively close to or coincides with the outer surface of the billet. In an embodiment, prior to the heat treatment, the first grain structure may comprise grains having a first average grain size, and the inductive heat treatment may cause increase grain size so that the second grain structure may comprise grains having a second average grain size. In any case, the term "gamma prime solvus temperature" as used herein may be defined as a temperature at which gamma prime precipitates are effectively re-solutioned and significant grain growth occurs due to a lack of effective grain boundary pinning. In accordance with an embodiment, the inductive heat treatment may occur at a temperature that is about 15° C. above the gamma prime solvus temperature of the alloy. In another embodiment, the inductive heat treatment may occur at a temperature in a range of about 5 to about 50° C. greater than the gamma prime solvus temperature. In still another embodiment, the inductive heat treatment may occur at a temperature that is higher or lower than the aforementioned ranges. In an embodiment, the billet is subjected to the inductive heat treatment for a predetermined period of time. For example, a particular axial location of the billet may be inductively heat treated for a time period in a range of about 1 minute to about 10 minutes. In other embodiments, inductive heat treatment may be longer or shorter than the aforementioned time period and may be particularly selected based on a desired grain size, particular dimensions of the billet, and/or particular dimensions of the induction coil. For example, a deeper region of larger grains may be formed when the billet is subjected to induction heat treatment for longer time periods. After the billet is inductively heat treated, the first grain structure in an outer portion of the billet is transformed into a second grain structure that is coarser than the first grain structure.

To achieve the required mechanical properties in the bore region, the billet is subjected to a subsolvus heat treat temperature. As used herein, the term "subsolvus heat treat temperature" may be defined as a temperature that is below the gamma prime solvus temperature. Accordingly, a particular subsolvus heat treat temperature may depend on the specific composition of the selected powder material. In an embodiment, the billet may be subjected to a subsolvus heat treat temperature that is about 30° C. below the gamma prime solvus temperature of the alloy. In another embodiment, the billet may be subjected to a subsolvus heat treat temperature that is in a range of about 3.5° C. to about 25° C. lower than the gamma prime solvus temperature. In still another embodiment, the billet may be subjected to a subsolvus heat treat temperature that is higher or lower than the aforementioned ranges. In an embodiment, the billet is subjected to the subsolvus heat treat temperature for a predetermined period of time. For example, the subsolvus heat treatment may occur for a time period in a range of about 30 minutes to about 240 minutes. In other embodiments, subsolvus heat treatment may be longer or shorter than the aforementioned time period depending on particular dimensions of the billet.

The billet may be quenched after exposure to the subsolvus heat treat temperature. Quenching may be employed in order to prevent further grain growth or to prevent precipitation of deleterious phases or undesirable gamma prime precipitate size, distribution, or morphology. In an embodiment, quenching may be performed by cooling the billet to about 870° C. within a time period in a range of about 2 minutes to about 2 hours. To quench the billet, the billet is subjected to a cooling fluid such as still air, forced air, inert gas, water, oil, or molten salt.

Figure 3:
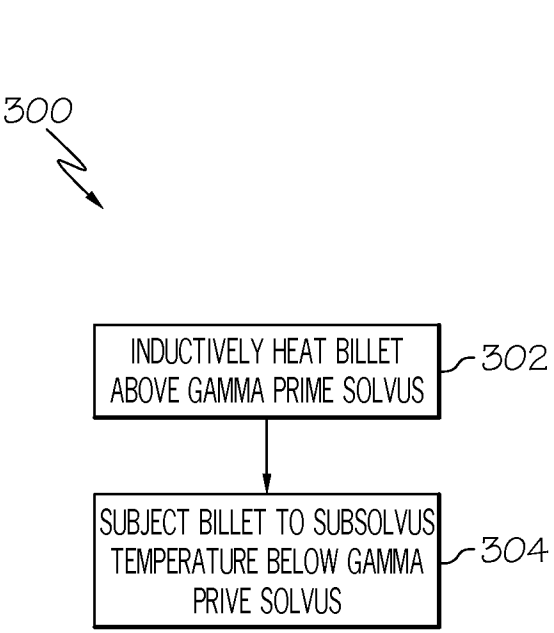
FIG. 3 is a flow diagram of an inductive heat treatment step of the method of forming a dual microstructure component depicted in FIG. 2, according to an embodiment.

Exposure to the inductive heat treatment and the subsolvus heat treatment may be interchanged, depending on desired rim or bore mechanical properties. FIG. 3 is a flow diagram 300 of step 204 of method 200, according to an embodiment. After the billet is consolidated (e.g., by both a HIP process and extrusion, formed only by the HIP process or formed only by extrusion), the billet may be subjected to induction heating, step 302, which may be performed in a manner similar to that described in step 204. As noted above, induction heating may occur in a HIP container or extrusion apparatus, in an embodiment. In other embodiments, the billet may be removed from the HIP container or extrusion apparatus, and induction heating may be performed in a different location. In any case, induction heating causes grains in an outer portion of the billet to grow in size so that the billet has a dual microstructure. According to an embodiment, the billet may be exposed to the subsolvus heat treat temperature, step 304, to thereby improve the tensile property of the billet. Step 304 may be performed in a manner similar to that described above in step 204.

Figure 4:
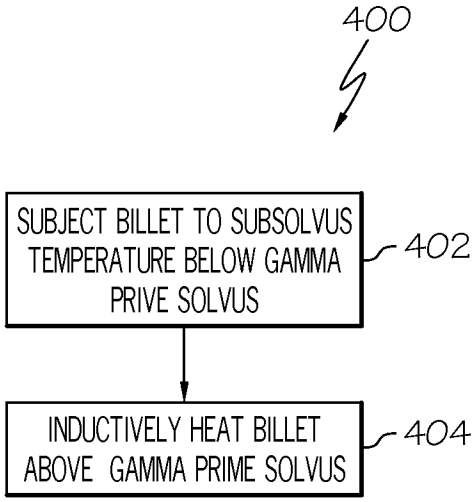
FIG. 4 is a flow diagram of an inductive heat treatment step of the method of forming a dual microstructure component depicted in FIG. 2, according to another embodiment.

FIG. 4 is a flow diagram 400 of step 204 of method 200, according to another embodiment. Here, the billet may be subjected to the subsolvus heat treat temperature before induction heating. Such an embodiment may be desirable when rim properties are performance-limiting. In an embodiment of step 204, after the billet has been consolidated (e.g., by both a HIP process and extrusion, formed only by the HIP process or formed only by extrusion), the billet may be subjected to the subsolvus heat treat temperature, step 402. According to an embodiment, the billet may be exposed to the subsolvus heat treat temperature to thereby improve the tensile property of the billet. Step 402 may be performed in a manner similar to that described above in step 204. In accordance with an embodiment, step 402 may occur in the container within which consolidation occurred. In such case, the billet may be removed from the container after step 402. Next, the billet may be inductively heated, step 404, which may be performed in a manner similar to that described in step 204. After the billet is treated, the billet includes a first grain structure in its inner portion and a second grain structure in an outer portion.

Returning again to FIG. 2, regardless of whether inductive heating or exposure to subsolvus temperature occurs first, after the billet is treated to impart the first and second grain structures thereto, the billet is subjected to post-formation processing, step 206. In an embodiment, a post-formation process may include allowing the billet to age in order to achieve a desired precipitate size, distribution, and morphology. For example, the billet may be exposed to temperatures above 704° C. for about 20 hours. In accordance with another embodiment, the billet may be divided into at least two sections. In an embodiment the billet may be divided after aging. In another embodiment the billet may be divided without aging or aging may be performed after the billet is divided. According to an embodiment, the billet is sliced into the at least two sections by employing conventional parting methods, including band saw cutting, abrasive cutting, waterjet, or EDM. The total number of sections may depend on a total axial length of the billet. For example, a billet having an axial length in a range of about 1 meter to about 3 meters may be separated into 10 sections. Each section may be used to form a single component, in an embodiment. In still other embodiments, each section may be employed to form more than one component. In some embodiments, one or more of the sections may be machined into a final shape to form the dual microstructure component. For example, the each section may be employed to form a single turbine disk. In other embodiments, each section may be employed to form a single compressor blisk.

Figure 5:
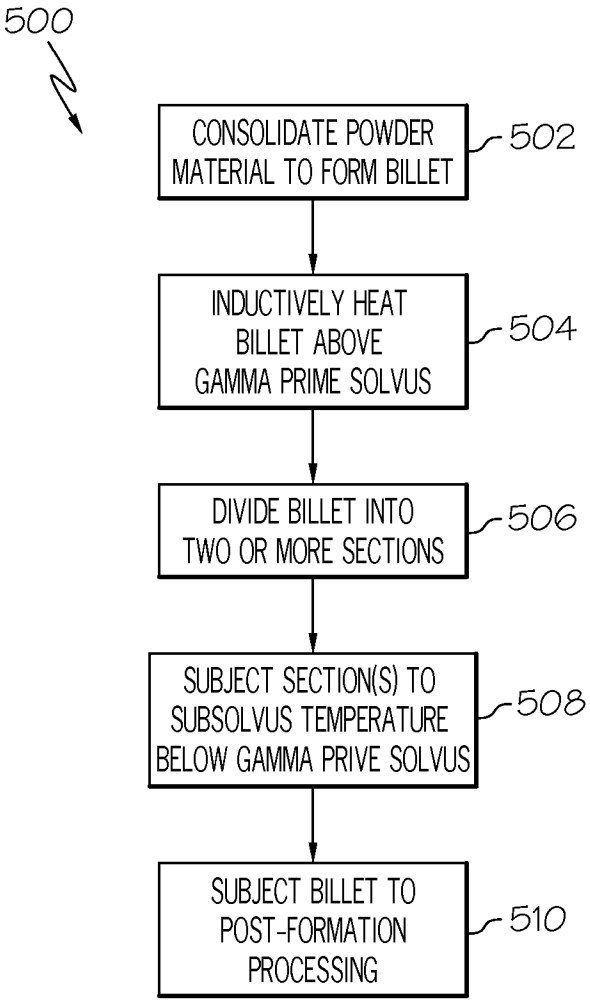
FIG. 5 is a flow diagram of a method of forming a dual microstructure component, according to still another embodiment.

FIG. 5 is a flow diagram of a method 500 of forming a dual microstructure component, according to another embodiment. Here, powder material comprising an alloy is consolidated to form a billet, step 502. The powder material and consolidation may occur in a manner similar to that described above for step 202. In any case, the billet is formed such that it includes a first microstructure. Next, the billet may be inductively heated, step 504. In an embodiment, inductively heating the billet results in a transformation of the first microstructure at an outer portion of the billet to a second microstructure. For example, the second microstructure may include grains that are coarser than grains of the first microstructure.

Subsequently, the billet may be divided into two or more sections, step 506. In an embodiment, step 506 may be performed in a manner similar to that described in step 206. One or more of the sections are subjected to a sub-solvus heat treat temperature, step 508, which may include processes similar to those described in step 204. Each section may be subjected to post formation processing, step 510. For example, the post formation processing may include aging and machining the billet into a final shape to form the dual microstructure component, as described above for step 206.

The dual microstructure component formed by the processes described above may have improved properties over those formed by conventional processes. For example, because the dual microstructure component is consolidated from a single powder material, rather than multiple materials, the dual microstructure component does not include bond joints, to which additional process steps may be performed. Additionally, by initially forming a billet, inductively heating the billet, and subsequently dividing the billet into two or more sections, more than one dual microstructure component may be formed at a time. Accordingly, the above-described method may be more time- and cost-efficient than conventional dual microstructure formation processes. Moreover, because the above-described method omits isothermal forging of the billet, which may be included in conventional processes, the above-described method may be employed to form components, such as disks, having relatively small outer dimensions. For example, turbine disks for auxiliary power units, unmanned or manned propulsion engines or power generation may be formed using the above-described methods.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A method of forming a dual microstructure component, the method comprising the steps of:

consolidating a powder material comprising an alloy via HIP processing and/or extrusion to form a solid, cylindrical billet having an axial length from about 1 meter to about 3 meters, the billet having a first grain structure;

inductively heating the solid, cylindrical billet at an inductive heat treat temperature above a gamma prime solvus temperature of the alloy and subjecting the solid, cylindrical billet to a subsolvus heat treat temperature that is below the gamma prime solvus temperature of the alloy in a range of about 3.5° C. to about 25° C. lower than the gamma prime solvus temperature of the alloy;

waiting a period of time for the first grain structure in an outer portion of the solid, cylindrical billet to transform into a second grain structure that is coarser than the first grain structure, after the steps of inductively heating and subjecting the solid, cylindrical billet to the subsolvus heat treat temperature;

slicing the solid, cylindrical billet into at least ten sections subsequent to the steps of inductively heating the billet and waiting a period of time; and machining a final shape into one or more of the at least ten sections to form the dual microstructure component, wherein the step of machining comprises forming a bore hole in the ten or more sections to form a turbine disk shape, and wherein the method omits isothermal forging of the at least ten sections.

2. The method of claim 1, wherein:

the step of consolidating includes subjecting the powder material to a hot isostatic press process to form a densified substrate.

3. The method of claim 2, wherein:

the step of consolidating further comprises extruding the densified substrate to impart the first grain structure into the billet.

4. The method of claim 3, wherein the cylindrical, solid billet is formed so as to have a relatively small diameter suitable for processing into turbine disks for use in an auxiliary power unit (APU).

5. The method of claim 4, wherein the cylindrical, solid billet is formed in a HIP container the has inner dimensions between about 5 cm and about 50 cm.

6. The method of claim 2, wherein inductively heating the billet is performed after subjecting the billet to a subsolvus heat treat temperature.

7. The method of claim 2, wherein inductively heating the billet is performed before subjecting the billet to a subsolvus heat treat temperature.

8. The method of claim 1, wherein:

the step of consolidating includes extruding the powder material to form the billet.

9. The method of claim 8, wherein inductively heating the billet is performed after subjecting the billet to a subsolvus heat treat temperature.

10. The method of claim 8, wherein inductively heating the billet is performed before subjecting the billet to a subsolvus heat treat temperature.

11. The method of claim 1, further comprising the step of aging the billet, after the step of inductively heating.

12. The method of claim 1, wherein the step of inductively heating comprises passing the billet through an inductive coil, while supplying the inductive coil with current.

13. The method of claim 1, wherein each axial location on the billet is subjected to the step of inductively heating for a time period in a range of about 1 minute to about 10 minutes.

14. The method of claim 1, wherein the final shape comprises turbine disk.

15. A method of forming a dual microstructure component, the method comprising the steps of:

consolidating a powder material comprising an alloy via HIP processing and/or extrusion to form a solid, cylindrical billet having an axial length from about 1 meter to about 3 meters, the billet having a first grain structure;

inductively heating the solid, cylindrical billet at an inductive heat treat temperature above a gamma prime solvus temperature of the alloy and subjecting the solid, cylindrical billet to a subsolvus heat treat temperature that is below the gamma prime solvus temperature of the alloy in a range of about 3.5° C. to about 25° C. lower than the gamma prime solvus temperature of the alloy;

waiting a period of time for the first grain structure in an outer portion of the solid, cylindrical billet to transform into a second grain structure that is coarser than the first grain structure, after the steps of inductively heating and subjecting the solid, cylindrical billet to the subsolvus heat treat temperature;

slicing the solid, cylindrical billet into at least ten sections subsequent to the steps of inductively heating the billet and waiting a period of time; and machining a final shape into one or more of the at least ten sections to form the dual microstructure component, wherein the step of machining comprises forming a turbine disk shape, and wherein the method omits isothermal forging of the at least ten sections.

16. A method of forming a dual microstructure component, the method comprising the steps of:

consolidating a powder material comprising an alloy via HIP processing and/or extrusion to form a solid, cylindrical billet, the billet having a first grain structure;

inductively heating the solid, cylindrical billet at an inductive heat treat temperature above a gamma prime solvus temperature of the alloy and subjecting the solid, cylindrical billet to a subsolvus heat treat temperature that is below the gamma prime solvus temperature of the alloy in a range lower than the gamma prime solvus temperature of the alloy;

waiting a period of time for the first grain structure in an outer portion of the solid, cylindrical billet to transform into a second grain structure that is coarser than the first grain structure, after the steps of inductively heating and subjecting the solid, cylindrical billet to the subsolvus heat treat temperature;

slicing the solid, cylindrical billet into at least two sections subsequent to the steps of inductively heating the billet and waiting a period of time; and machining a final shape into one or more of the at least two sections to form the dual microstructure component, wherein the step of machining comprises forming a turbine disk shape that includes a bore hole, and wherein the method omits isothermal forging of the at least two sections.

* * * * *